US006202751B1

(12) United States Patent
Chatterji et al.

(10) Patent No.: US 6,202,751 B1
(45) Date of Patent: Mar. 20, 2001

(54) METHODS AND COMPOSITIONS FOR FORMING PERMEABLE CEMENT SAND SCREENS IN WELL BORES

(75) Inventors: Jiten Chatterji, Duncan; Roger S. Cromwell, Walters; Baireddy R. Reddy, Duncan; Bobby J. King, Duncan; Philip D. Nguyen, Duncan; David L. Brown, Temple, all of OK (US)

(73) Assignee: Halliburton Energy Sevices, Inc., Duncan, OK (US)

( * ) Notice: Subject to any disclaimer, the term of this patent is extended or adjusted under 35 U.S.C. 154(b) by 0 days.

(21) Appl. No.: 09/627,264

(22) Filed: Jul. 28, 2000

(51) Int. Cl.[7] ..... E21B 33/138; E21B 43/02

(52) U.S. Cl. ..... 166/276; 106/678; 106/724; 106/725; 106/727; 106/730; 106/738; 106/819; 106/820; 106/823; 106/293; 106/300; 106/309

(58) Field of Search ..... 166/276, 293, 166/300, 309; 106/678, 724, 725, 727, 730, 738, 819, 820, 823

(56) References Cited

U.S. PATENT DOCUMENTS

| | | | | |
|---|---|---|---|---|
| 2,135,909 | * | 11/1938 | Monson | 166/300 |
| 2,187,895 | * | 1/1940 | Sanders | 166/276 |
| 2,190,989 | * | 2/1940 | Johnston | 166/276 |
| 2,193,808 | * | 3/1940 | Dieterich | 166/276 |
| 2,288,557 | * | 6/1942 | Vollmer | 166/276 |
| 3,044,547 | * | 7/1962 | Jarboe, Jr. | 166/276 |
| 3,119,448 | * | 1/1964 | Rhoades | 166/276 X |
| 3,368,623 | * | 2/1968 | Carter et al. | 166/276 |
| 3,605,899 | * | 9/1971 | Tate et al. | 166/300 |
| 3,816,151 | * | 6/1974 | Podlas | 166/300 X |
| 3,862,663 | * | 1/1975 | Curtice et al. | 166/276 |
| 5,062,484 | * | 11/1991 | Schroeder, Jr. et al. | 166/300 X |
| 5,339,902 | | 8/1994 | Harris et al. | 166/293 |
| 5,363,916 | | 11/1994 | Himes et al. | 166/276 |
| 5,529,123 | * | 6/1996 | Carpenter et al. | 166/293 |
| 6,063,738 | * | 5/2000 | Chatterji et al. | 166/293 X |

* cited by examiner

*Primary Examiner*—George Suchfield
(74) *Attorney, Agent, or Firm*—Craig W. Roddy; C. Clark Dougherty, Jr.

(57) ABSTRACT

Methods and compositions for forming permeable cement sand screens in well bores are provided. The compositions are basically comprised of a hydraulic cement, an acid soluble particulate solid, a liquid hydrocarbon solvent soluble particulate solid, a particulate cross-linked gel containing an internal breaker which after time causes the gel to break into a liquid, water present in an amount sufficient to form a slurry, a gas present in an amount sufficient to form a foam and a mixture of foaming and foamed stabilizing surfactants.

14 Claims, No Drawings

METHODS AND COMPOSITIONS FOR FORMING PERMEABLE CEMENT SAND SCREENS IN WELL BORES

BACKGROUND OF THE INVENTION

1. Field of the Invention

The present invention provides methods and compositions for forming permeable cement sand screens in well bores to prevent sand from flowing into the well bores with produced hydrocarbons and other fluids.

2. Description of the Prior Art

Oil, gas and water producing wells are often completed in unconsolidated subterranean formations containing loose or incompetent sand which flow into the well bores with produced fluids. The presence of the sand in the produced fluids rapidly erodes metal tubular goods and other production equipment which often substantially increases the costs of operating the wells.

Heretofore, gravel packs have been utilized in wells to prevent the production of formation sand. In gravel packing operations, a pack of gravel, e.g., graded sand, is placed in the annulus between a perforated or slotted liner or screen and the walls of the well bore in the producing interval. The resulting structure provides a barrier to migrating sand from the producing formation while allowing the flow of produced fluids.

While gravel packs successfully prevent the production of sand with formation fluids, they often fail and require replacement due, for example, to the deterioration of the perforated or slotted liner or screen as a result of corrosion or the like. The initial installation of a gravel pack adds considerable expense to the cost of completing a well and the removal and replacement of a failed gravel pack is even more costly.

Thus, there are continuing needs for improved methods of preventing the production of formation sand, fines and the like with produced subterranean formation fluids.

SUMMARY OF THE INVENTION

The present invention provides improved methods and compositions for forming permeable cement sand screens in well bores which meet the needs described above and overcome the deficiencies of the prior art. The methods of the invention are basically comprised of the following steps. A foamed cement composition is prepared comprised of a hydraulic cement, an acid soluble particulate solid, a liquid hydrocarbon solvent soluble particulate solid, a particulate cross-linked gel containing a delayed internal breaker which after time causes the gel to break into a liquid, water present in an amount sufficient to form a slurry, a gas present in an amount sufficient to form a foam and a mixture of foaming an d foam stabilizing surfactants. The foamed cement composition is placed in a well bore adjacent to a fluid producing interval therein aid the cement composition is allowed to set The particulate cross-linked gel containing a delayed internal breaker is allowed to break whereby vugs and channels are formed in the set cement. Thereafter, the set cement is contacted with an acid and a liquid hydrocarbon solvent so that the acid and liquid hydrocarbon solvent enter the vugs and channels in the set cement and dissolve at least portions of the acid soluble particulate solid and the liquid hydrocarbon solvent soluble particulate solid in the set cement whereby the set cement is permeated. The resulting permeable set cement in the well bore functions as a sand screen, i.e., the permeable cement allows produced fluids to flow into the well bore, but prevents formation sand and the like from flowing therein. Because the permeable cement sand screen fills the portion of the well bore adjacent to a producing interval and bonds to the walls of the well bore, the permeable cement can not be bypassed and does not readily deteriorate. In addition, as produced liquid hydrocarbons flow through the permeable cement, additional liquid hydrocarbon solvent soluble particulate solid in the cement is dissolved thereby gradually increasing the permeability of the cement.

The compositions of this invention for forming a permeable cement sand screen in a well bore are basically comprised of a hydraulic cement, an acid soluble particulate solid, a liquid hydrocarbon solvent soluble particulate solid, a particulate cross-linked gel containing a delayed internal breaker which after time causes the gel to break into a liquid, water present in an amount sufficient to form a slurry, a gas present in an amount sufficient to form a foam and a mixture of foaming and foam stabilizing surfactants.

It is, therefore, a general object of the present invention to provide improved methods and compositions for forming permeable cement sand screens in well bores.

Other and further objects, features and advantages of the present invention will be readily apparent to those skilled in the art upon a reading of the description of preferred embodiments which follows.

DESCRIPTION OF PREFERRED EMBODIMENTS

In accordance with the methods of this invention, a permeable cement sand screen is formed in a well bore adjacent to a producing interval or zone whereby loose and incompetent sand and fines are prevented from entering the well bore with fluids produced from the interval or zone. The methods are basically comprised of the following steps. A foamed cement composition is prepared comprised of a hydraulic cement, an acid soluble particulate solid, a liquid hydrocarbon solvent soluble particulate solid, a particulate cross-linked gel containing a delayed internal breaker which after time causes the gel to break into a liquid, water present in an amount sufficient to form a slurry, a gas present in an amount sufficient to form a foam and a mixture of foaming and foam stabilizing surfactants. The foamed cement composition is placed in the well bore adjacent to a fluid, e.g., oil and/or gas with or without water, producing interval or zone and the cement composition is allowed to set therein whereby the cement composition fills and forms a column in the well bore adjacent to the producing formation or zone and bonds to the walls of the well bore. The particulate cross-linked gel containing a delayed internal breaker in the set cement composition is allowed to break whereby vugs and channels are formed in the set cement column. Thereafter, an acid and a liquid hydrocarbon solvent are introduced into the well bore whereby the set cement column therein is contacted therewith, the acid and liquid hydrocarbon solvent enter the vugs and channels in the set cement and dissolve at least portions of the acid soluble particulate solid and the liquid hydrocarbon solvent soluble particulate solid in the cement composition and as a result, the set cement composition is permeated throughout its length and width.

After the permeable set cement column has been formed in the well bore, the well is produced and the permeable set cement column functions as a sand screen. That is, produced liquids and gases flow through the permeable set cement column into the well bore, but formation sand and fines in the formation are prevented from passing through the permeable set cement.

While a variety of hydraulic cements can be utilized in the foamed cement composition of this invention, Portland cements or their equivalents are generally preferred. Portland cements of the types defined and described in *API Specification For Materials And Testing For Well Cements*, API Specification 10, Fifth Edition, dated Jul. 1, 1990 of the American Petroleum Institute are particularly suitable. Preferred such API Portland cements include classes A, B, C, G and H, with API classes G and H being more preferred and class H being the most preferred.

The acid soluble particulate solid in the cement composition can be any particulate solid material which is acid soluble and does not adversely react with the other components of the cement composition. Examples of suitable acid soluble particulate solids include, but are not limited to, calcium carbonate, magnesium carbonate and zinc carbonate. Of these, calcium carbonate is preferred. The acid soluble particulate solid used is generally included in the cement composition in an amount in the range of from about 2.5% to about 25% by weight of cement in the composition, more preferably in an amount of from about 5% to about 10% and most preferably about 5%.

The liquid hydrocarbon solvent soluble particulate solid can also be any of a variety of liquid hydrocarbon solvent soluble materials which do not adversely react with any of the other components in the cement composition. Examples of such materials include, but are not limited to, gilsonite, naphthalene, polystyrene beads and asphaltene. Of these, particulate gilsonite is the most preferred. The hydrocarbon soluble particulate solid used is generally included in the cement composition in an amount in the range of from about 2.5% to about 25% by weight of cement in the composition, more preferably in an amount of from about 5% to about 10% and most preferably about 10%.

The particulate cross-linked gel containing a delayed internal breaker utilized in accordance with this invention is preferably comprised of water, a hydratable polymer of hydroxyalkylcellulose grafted with vinyl phosphonic acid, a delayed breaker selected from the group consisting of hemicellulase, encapsulated ammonium persulfate, ammonium persulfate activated with ethanol amines and sodium chlorite and a cross-linking agent comprised of a Bronsted-Lowry or Lewis base.

The particular delayed internal breaker utilized in the cross-linked gel depends on the temperature in the well bore at the location where the cement composition is placed. If the temperature is in the range of from about 80° F. to about 125° F. hemicellulase is utilized. If the temperature is in the range of from about 80° F. to about 250° F., encapsulated ammonium persulfate is utilized. If the temperature is in the range of from about 70° F. to about 100° F., ammonium persulfate activated with ethanol amines is used, and if the temperature is in the range of from about 140° F. to about 200° F. sodium chlorite is utilized. The amount of the delayed internal breaker utilized in the cross-linked gel is such that the gel will break into a liquid in a time period which allows the cement composition to be prepared, placed and set prior to when the gel breaks, e.g., a time period in the range of from about 12 to about 24 hours.

The particulate cross-linked gel containing a delayed internal breaker is generally included in the cement composition in an amount in the range of from about 10% to about 30% by weight of cement in the composition, more preferably in an amount of from about 10% to about 20% and most preferably about 20%.

The water in the foamed cement composition can be fresh water or salt water. The term "salt water" is used herein to mean unsaturated salt solutions and saturated salt solutions including brines and seawater. The water is generally present in the cement composition in an amount sufficient to form a slurry of the solids in the cement composition, i.e., an amount in the range of from about 30% to about 70% by weight of cement in the composition.

The gas utilized for foaming the cement composition can be air or nitrogen, with nitrogen being preferred. The gas is generally present in an amount sufficient to foam the cement composition, i.e., an amount in the range of from about 10% to about 50% by volume of the cement composition.

While various mixtures of foaming and foam stabilizing surfactants can be included in the foamed cement composition, a preferred mixture is comprised of an ethoxylated alcohol ether sulfate surfactant of the formula $$H(CH_2)_a(OC_2H_4)_bOSO_3NH_4^+$$

wherein a is an integer in the range of from about 6 to about 10 and b is an integer in the range of from about 3 to about 10; an alkyl or alkene amidopropylbetaine surfactant having the formula $$R—CONHCH_2CH_2CH_2N^+(CH_3)_2CH_2CO_2^-$$

wherein R is a radical selected from the group of decyl, cocoyl, lauryl, cetyl and oleyl; and an alkyl or alkene amidopropyldimethylamine oxide surfactant having the formula $$R—CONHCH_2CH_2CH_2N^+(CH_3)_2O^-$$

wherein R is a radical selected from the group of decyl, cocoyl, lauryl, cetyl and oleyl. The ethoxylated alcohol ether sulfate surfactant is generally present in the mixture in an amount in the range of from about 60 to about 64 parts by weight. The alkyl or alkene amidopropylbetaine surfactant is generally present in the mixture in an amount in the range of from about 30 to about 33 parts by weight, and the alkyl or alkene amidopropyldimethylamine oxide surfactant is generally present in the mixture in an amount in the range of from about 3 to about 10 parts by weight. The mixture can optionally include fresh water in an amount sufficient to dissolve the surfactants whereby it can more easily be combined with a cement slurry.

A particularly preferred surfactant mixture for use in accordance with this invention is comprised of an ethoxylated hexanol ether sulfate surfactant present in an amount of about 63.3 parts by weight of the mixture, a cocoylamidopropyl betaine surfactant present in an amount of about 31.7 parts by weight of the mixture and cocoylamidopropyldimethylamine oxide present in an mount of about 5 parts by weight of the mixture.

The mixture of foaming and foam stabilizing surfactants is generally included in the cement composition of this invention in an amount in the range of from about 1% to about 5% by volume of water in the composition.

The acid used for contacting the set cement composition in the well bore can be any of a variety of acids or aqueous acid solutions. Examples of aqueous acid solutions which can be used include, but are not limited to, aqueous hydrochloric acid solutions, aqueous acetic acid solutions and aqueous formic acid solutions. Generally, an aqueous hydrochloric acid solution is preferred with a 5% by weight hydrochloric acid solution being the most preferred.

A variety of liquid hydrocarbon solvents can also be utilized in accordance with this invention to dissolve the liquid hydrocarbon soluble particulate solid utilized. While both liquid aliphatic hydrocarbons and mixtures thereof and liquid aromatic hydrocarbons and mixtures thereof can be utilized, liquid aromatic hydrocarbons are preferred. A particularly suitable liquid aromatic hydrocarbon solvent for use in dissolving particulate gilsonite is xylene. As will be understood, the particular acid or aqueous acid solution utilized should be capable of rapidly dissolving the acid soluble particulate solid used and the particular liquid hydrocarbon solvent used should be capable of rapidly dissolving the particulate liquid hydrocarbon soluble solid utilized.

The acid and the liquid hydrocarbon solvent utilized can contact the cement composition separately or simultaneously. In a preferred technique, an aqueous acid solution and a liquid hydrocarbon solvent are emulsified, and the emulsion is pumped into contact with the cement composition in the well bore in a quantity and for a time period sufficient to dissolve at least major portions of the dissolvable particulate solid materials in the cement composition.

A particularly suitable method of the present invention for forming a permeable cement sand screen in a well bore is comprised of the steps of: (a) preparing a foamed cement composition comprised of Portland Class H cement, an acid soluble particulate solid comprised of calcium carbonate, a liquid hydrocarbon solvent soluble particulate solid comprised of gilsonite, a particulate cross-linked gel containing a delayed internal breaker comprised of water, a hydratable polymer of hydroxyethylcellulose grafted with vinyl phosphonic acid, a delayed breaker capable of breaking the cross-linked gel at a selected temperature and a cross-linking agent comprised of a Bronsted-Lowry or Lewis base, water present in an amount sufficient to form a slurry, nitrogen gas present in an amount sufficient to form a foam and a mixture of foaming and foam stabilizing surfactants comprised of an ethoxylated hexanol ether sulfate surfactant, a cocoylamidopropylbetaine surfactant and a cocoylamidopropyldimethylamine oxide; (b) placing the foamed cement composition prepared in step (a) in the well bore adjacent to a fluid producing interval or zone and allowing the cement composition to set therein; (c) allowing the particulate cross-linked gel containing an internal breaker to break whereby vugs and channels are formed in the set cement composition; and thereafter (d) contacting the set cement with an acid and a liquid hydrocarbon solvent so that the acid and liquid hydrocarbon solvent enter the vugs and channels in the set cement and dissolve at least portions of the particulate calcium carbonate and the particulate gilsonite in the set cement whereby the set cement is permeated.

A preferred composition of this invention for forming a permeable cement sand screen in a well bore is comprised of Portland class H cement; particulate solid calcium carbonate; particulate solid gilsonite; a particulate cross-linked gel containing a delayed internal breaker comprised of water, a hydratable polymer of hydroxyethylcellulose grafted with vinyl phosphonic acid, an internal breaker selected to break the gel at a selected temperature and a cross-linking agent comprised of magnesium oxide; water present in an amount sufficient to form a slurry; nitrogen gas present in an amount sufficient to form a foam; and a mixture of foaming and foam stabilizing surfactants comprised of ethoxylated hexanol ether sulfate surfactant, a cocoylamidopropylbetaine surfactant and a cocoylamidopropyldimethylamine oxide surfactant.

The acid utilized for dissolving the calcium carbonate in the above composition is preferably a 5% by weight aqueous hydrochloric acid solution and the liquid hydrocarbon solvent for dissolving the particulate gilsonite is preferably xylene.

In order to further illustrate the methods and compositions of the present invention, the following example is given.

EXAMPLE

An internal breaker comprised of sodium chlorite was added to a 2% solution of a polymer of hydroxyethylcellulose grafted with vinyl phosphonic acid. The hydrated polymer was then cross-linked with magnesium oxide. The resulting cross-linked gel was graded into small pieces in a Waring blender. The particulate cross-linked gel was then added to test portions of fresh water to be used in preparing test cement slurries.

Separate quantities of API Portland Class H cement were dry blended with calcium carbonate in amounts varying from about 5% to about 10% by weight of the cement along with particulate gilsonite in an amount of 10% by weight of the cement. Test cement slurries were then prepared utilizing the test portions of water containing the above described particulate cross-linked gel in amounts such that the test cement slurries contained particulate cross-linked gel in the amount of 20% of the cement in the test slurries. The test cement slurries containing particulate cross-linked gel, particulate calcium carbonate and particulate gilsonite were mixed to a density of 15.9 pounds per gallon. Mixtures of foaming and foam stabilizing surfactants were added to the test slurries in amounts of 1% by volume of the water in the slurries. The test slurries were then foamed with air to densities of 11.2 pounds per gallon. The mixtures of foaming and foam stabilizing surfactants were comprised of an ethoxylated hexanol ether sulfate surfactant in an amount of about 63.3 parts by weight, a cocoylamidopropylbetaine surfactant present in an amount of about 31.7 parts by weight and a cocoylamidopropyldimethylamine oxide present in an amount of about 5 parts by weight. The test foamed cement slurries were then placed in an oven at 140° F. and allowed to set for 72 hours. As a result of the internal breakers in the cross-linked gels in the set foamed cement compositions, the gels reverted to liquids and formed vugs and channels in the test set cement compositions.

Each of the test set cement compositions were cored to obtain plugs having dimensions of 2 inches in length by 15/16 inch in diameter. Each core was placed in a fluid loss cell equipped with a core holder and the initial permeability of the core was determined in accordance with the procedure set forth in the above mentioned API Specification 10 using an aqueous 2% by weight potassium chloride solution. Thereafter, an emulsified acid containing 50% by weight of an aqueous 5% hydrochloric acid solution and 50% by weight of an aromatic hydrocarbon solvent, i.e., xylene, was flowed through the core.

The emulsion of hydrochloric acid and xylene flowed into the vugs and channels in the core and dissolved particulate calcium carbonate and particulate gilsonite therein which created additional pathways and interconnected channels in each core. A total of two pore volumes of emulsified acid and xylene were used to dissolve the calcium carbonate and gilsonite in each core. Following the acid-xylene emulsion treatment, the final permeability of each core was determined using an aqueous 2% by weight potassium chloride solution. The compressive strength of two cores were tested for compressive strength before and after being permeated.

The quantities of components in the various test cement compositions along with the results of the permeability and compressive strength tests are set forth in the Table below.

TABLE

Permeable Set Cement[1] Tests

| Test Core No. | Amount of Water[2], % by wt. of cement | Amount of Calcium Carbonate, % by wt. of cement | Amount of Gilsonite, % by wt. of cement | Amount of Cross-Linked Gel[3], % by wt. of cement | Initial Permeability, Darcies × $10^{-3}$ | Final Permeability, Darcies | Initial Compressive Strength, psi | Final Compressive Strength, psi |
|---|---|---|---|---|---|---|---|---|
| 1 | 37 | 5 | 10 | 20 | 5.4 | 32.7 | 1064 | 580 |
| 2 | 37 | 5 | 10 | 20 | 9.5 | 32 | 1060 | 575 |
| 3[4] | 37 | 5 | 10 | 20 | 12.4 | 1.211 | — | — |
| 4[4] | 37 | 5 | 10 | 20 | 10.1 | 0.97889 | — | — |
| 5[4] | 37 | 5 | 10 | 20 | 3.4 | 0.66 | — | — |
| 6[4] | 37 | 7.5 | 10 | 20 | 1.26 | 27.2 | — | — |
| 7[4] | 37 | 10 | 10 | 20 | 0.9 | 28 | — | — |
| 8 | 37 | 7.5 | 10 | 20 | 12.06 | 29.6 | — | — |
| 9 | 37 | 10 | 10 | 20 | 48.6 | 30.2 | — | — |

[1]Portland Class H cement
[2]Fresh water
[3]Hydroxyethylcellulose grafted with vinyl phosphonic acid cross-linked with magnesium oxide (See U. S. Pat. No. 5,363,916 issued to Himes et al.)
[4]Cement compositions were attached to ceramic cores to simulate the well formation From the Table, it can be seen that the permeability was greatly increased by the acid-xylene emulsion and that the permeable cores had adequate compressive strengths to function as sand screens in well bores. Only a portion of the gilsonite in the cores was dissolved by the two pore volumes of emulsion utilized. However, when such permeable set cement compositions are utilized in well bores, the flow of produced crude oil through the permeable cement will dissolve additional gilsonite thereby increasing the permeability of the cement.

Thus, the present invention is well adapted to carry out the objects and attain the ends and advantages mentioned as well as those which are inherent therein. While numerous changes may be made by those skilled in the art, such changes are encompassed within the spirit of this invention as defined by the appended claims.

What is claimed is:

1. A method of forming a permeable cement sand screen in a well bore comprising the steps of:

(a) preparing a foamed cement composition comprised of a hydraulic cement, an acid soluble particulate solid, a liquid hydrocarbon solvent soluble particulate solid, a particulate cross-linked gel containing an internal breaker which after time causes said gel to break into a liquid, water present in an amount sufficient to form a slurry, a gas present in an amount sufficient to form a foam and a mixture of foaming and foam stabilizing surfactants;

(b) placing said foamed cement composition prepared in step (a) in said well bore adjacent to a fluid producing interval or zone and allowing said cement composition to set therein;

(c) allowing said particulate cross-linked gel containing said internal breaker to break whereby vugs and channels are formed in said set cement; and thereafter (d) contacting said set cement with an acid and a liquid hydrocarbon solvent so that said acid and liquid hydrocarbon solvent enter said vugs and channels and dissolve said acid soluble particulate solid and said liquid hydrocarbon solvent soluble particulate solid in said set cement whereby said set cement is permeated.

2. The method of claim 1 wherein said hydraulic cement in said cement composition prepared in accordance with step (a) is Portland cement or the equivalent.

3. The method of claim 1 wherein said acid soluble particulate solid is calcium carbonate and is present in said cement composition prepared in accordance with step (a) in an amount in the range of from about 2.5% to about 25% by weight of cement in said composition.

4. The method of claim 1 wherein said aromatic solvent soluble particulate solid is particulate gilsonite and is present in said cement composition prepared in accordance with step (a) in an amount in the range of from about 2.5% to about 25% by weight of cement in said composition.

5. The method of claim 1 wherein said particulate cross-linked gel containing an internal breaker in said cement composition prepared in accordance with step (a) is comprised of water, a hydratable polymer of hydroxyalkylcellulose grafted with vinyl phosphonic acid, a breaker selected from the group consisting of hemicellulase, encapsulated ammonium persulfate, ammonium persulfate activated with ethanol amines and sodium chlorite and a cross-linking agent comprised of a Bronsted-Lowry or Lewis base.

6. The method of claim 5 wherein said particulate cross-linked gel containing an internal breaker is present in said cement composition prepared in accordance with step (a) in the range of from about 10% to about 30% by weight of cement in said composition.

7. The method of claim 1 wherein said water in said composition prepared in accordance with step (a) is selected from the group consisting of fresh water and salt water.

8. The method of claim 7 wherein said water is present in an amount in the range of from about 30% to about 70% by weight of cement in said composition.

9. The method of claim 1 wherein said mixture of foaming and foam stabilizing surfactants in said cement composition prepared in accordance with step (a) are comprised of an ethoxylated hexanol ether sulfate surfactant present in an amount of about 63.3 parts by weight of said mixture, a cocoylamidopropylbetaine surfactant present in an amount of about 31.7 parts by weight of said mixture and cocoylamidopropyldimethylamine oxide present in an amount of about 5 parts by weight of said mixture.

10. The method of claim 9 wherein said mixture of foaming and foam stabilizing surfactants is present in the range of from about 1% to about 5% by volume of water in said composition.

11. The method of claim 1 wherein said gas in said composition prepared in accordance with step (a) is selected from the group consisting of air and nitrogen.

12. The method of claim 1 wherein said acid used for contacting said set cement in accordance with step (d) is an aqueous hydrochloric acid solution.

13. The method of claim 1 wherein said liquid hydrocarbon solvent is xylene.

14. The method of claim 1 wherein said acid and liquid hydrocarbon solvent are formed into an emulsion prior to carrying out step (d).

* * * * *